US005784737A

United States Patent [19]

Tsuji

[11] Patent Number: 5,784,737

[45] Date of Patent: Jul. 28, 1998

[54] FOLDING SHOES AND PROCESS FOR MANUFACTURING THE SAME

[75] Inventor: Koutoku Tsuji, Kagawa-ken, Japan

[73] Assignees: Yoshitaka Tsuji; Teruyuki Tsuji, both of Kagawa, Japan

[21] Appl. No.: 954,562

[22] Filed: Oct. 20, 1997

Related U.S. Application Data

[60] Continuation of Ser. No. 685,004, Jul. 22, 1996, abandoned, which is a division of Ser. No. 935,425, Aug. 26, 1992, abandoned.

[51] Int. Cl.[6] ..... A43B 23/17; A43B 1/10

[52] U.S. Cl. ..... 12/142 E; 36/98; 36/102; 36/4; 36/47

[58] Field of Search ..... 12/142 E, 142 EV; 36/98, 102, 4, 47

[56] References Cited

U.S. PATENT DOCUMENTS

| | | | |
|---|---|---|---|
| 1,352,008 | 9/1920 | Lawrence | 12/142 E |
| 1,536,866 | 5/1925 | Kamborian | 12/142 EV |
| 2,462,239 | 2/1949 | Van Dinter et al. . | |
| 2,498,437 | 2/1950 | L'Hollier . | |
| 2,706,698 | 4/1955 | Daly et al. | 12/142 EV |
| 2,838,854 | 6/1958 | Dosmann . | |
| 4,366,629 | 1/1983 | Scherz . | |
| 4,476,600 | 10/1984 | Seidel et al. . | |
| 4,858,337 | 8/1989 | Barma . | |
| 4,945,127 | 7/1990 | Kagawa et al. . | |
| 5,068,982 | 12/1991 | Devasthal . | |
| 5,098,776 | 3/1992 | Kobayashi et al. . | |
| 5,106,445 | 4/1992 | Fukuoka . | |
| 5,189,110 | 2/1993 | Ikemato et al. . | |
| 5,189,814 | 3/1993 | Barma . | |

FOREIGN PATENT DOCUMENTS

| | | |
|---|---|---|
| 0284638 | 10/1988 | European Pat. Off. . |
| 2548579 | 1/1985 | France . |
| 2615366 | 11/1988 | France . |
| 50-109100 | 3/1977 | Japan . |
| 1347925 | 1/1988 | U.S.S.R. . |

OTHER PUBLICATIONS

Article –Mechanical Properties of Shape Memory Polymer of Polyurethan Series JSME International Journal, vol. 35, No. 3, 1992.

Article –Developments in Shape Memory Resins, No. 1, Nov. 1989.

Article –Japan Chemical Week, No. 1482, Sep. 1988.

Article –New Materials/Japan, vol. 4, No. 10, 1987.

Article –New Materials/Japand, vol. 6, No. 7, Jul. 1989.

Article –High Impact and Shock Absorbing, (Author: JACOVIC et al.).

*Primary Examiner*—Ted Kavanaugh

*Attorney, Agent, or Firm*—Armstrong,Westerman, Hattori, McLeland & Naughton

[57] ABSTRACT

This invention relates to folding shoes made with the use of shape-memory resins at least in their instep or, where a shaft is present, at least in their instep and shaft and transformable by folding into a given shape or restorable from the folded shape to the memorized shape by heating at a temperature above the glass transition temperature and below the melting temperature of said shape-memory resins and to a process for manufacturing said folding shoes. The folding shoes of this invention are of practical value as they can be restored to the memorized shape at the time of use, can be conveniently stored away or carried about in the fixed folded shape of reduced volume while not in use, and can be manufactured readily by the process of this invention.

5 Claims, 5 Drawing Sheets

FOLDING SHOES AND PROCESS FOR MANUFACTURING THE SAME

This application is a continuation of application Ser. No. 08/685,004 filed Jul. 22, 1996 now abandoned, which is a divisional of application Ser. No. 07/935,425 filed Aug. 26, 1992 now abandoned.

FIELD OF THE INVENTION AND RELATED ART STATEMENT

This invention relates to folding shoes made with the use of shape-memory resins and a process for manufacturing the same.

Shoes made from resins or rubber have been worn on a variety of occasions: for example, shoes called rubber-soled socks in farming and construction works; low shoes slipped on the instep in bathrooms; rain shoes; specially designed shoes reaching above the leg or even the hip in paddies and fishing; and sports shoes in skiing and skating. The area of service of shoes decides what part of the human body to cover and this in turn dictates their sizes.

In recent years, urban housing is becoming increasingly more limited in size and not enough space can be secured for the storage of footwear in apartment houses and housing complexes. In particular, bulky boots are at times unable to find their exclusive place of safekeeping in the vestibule and, in such cases, it becomes necessary to spend extra time to clean them with water after each wearing and store them in a closet.

Rain boots and special-purpose work shoes are too bulky to carry about. One would have difficulties in carrying rain boots with one even when it is threatening to rain or in carrying work shoes to the workplace if the distance is long.

OBJECT AND SUMMARY OF THE INVENTION

It is an object of this invention to provide a folding shoe which is made in whole or in part from shape-memory resins, can be restored to the memorized shape at the time of use, and can be folded into a smaller bulk and fixed in the folded shape while not in use and also to provide a process for manufacturing said shoe.

Another object of this invention is to provide a folding boot, namely bulky rain boot and work shoe, which is made in whole or in part from shape-memory resins, can be restored to the memorized shape at the time of use, and can be folded into a smaller bulk and fixed in the folded shape while not in use for storage and carrying and also to a process for manufacturing said boot.

This invention accordingly relates to a folding shoe which is made from shape-memory resins at least in its instep or, where a shaft is present, at least in its instep and shaft and can be folded into a given shape or restored from the folded shape to the memorized shape by heating at a temperature above the glass transition temperature and below the melting temperature of said shape-memory resins and also to a process for manufacturing said folding shoe.

The folding shoe of this invention is made from shape-memory resins at least in its instep or, where a shaft is present, at least in its instep and shaft. In consequence, heating the shoe at a temperature above the glass transition temperature and below the melting temperature of said shape-memory resins softens the instep and shaft and the shoe can be folded into a given shape and maintained in the folded shape when cooled in the folded state. The folded shape can be restored to the memorized shape when reheated at a temperature above the glass transition temperature and below the melting temperature of said shape-memory resins.

DETAILED DESCRIPTION OF THE PREFERRED EMBODIMENT

Figure 1:
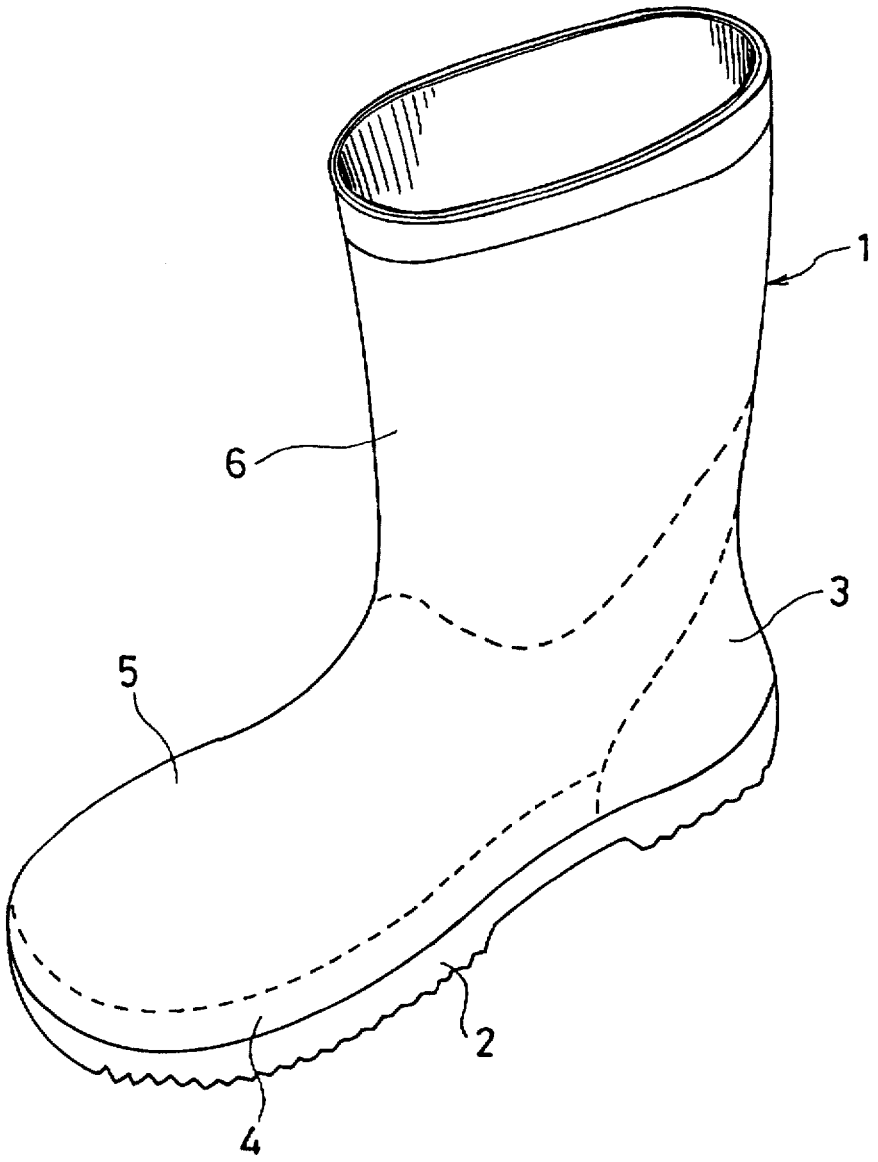
FIG. 1 is an oblique projection drawing of a folding rain boot in an example of this invention.

The present inventors have conducted extensive studies to solve the aforesaid problems of prior-art technologies, arrived at a discovery that a shoe made from shape-memory resins can be restored to the memorized shape as needed and folded into a smaller bulk and fixed in the folded shape for storage or carrying while not in use, and completed this invention.

In order to reduce the bulk of a shoe as much as possible by folding while not in use, it is necessary in this invention to make at least its instep or, where a shaft is present, at least its instep and shaft from shape-memory resins. Regarding other parts of the shoe, for example, a sole, a heel, and a toe, they may be made either from shape-memory resins or from other known materials depending upon the service the particular shoe is to perform.

The shape-memory resins useful for this invention are not limited to any specific ones and known shape-memory resins such as polyurethanes, polybutadiene-polystyrene copolymers, polynorbornene, and polyisoprene are applicable. Of those, polyurethanes and polyisoprene with a glass transition temperature ($T_g$) of 40° to 70° C. are preferable as they allow free setting of the shape-restoring temperature in a given range and also they can be molded like ordinary plastics. The shape-memory resins are chosen in consideration of such factors as the relationship between the area of service of shoes (particularly the environmental temperature while in service) and the shape-restoring temperature. In the cases where a certain degree of flexibility is required for shoes, the shape-memory resins may be compounded suitably with other resins and rubbers such as plasticized poly(vinyl chloride) and synthetic rubbers.

As for a sole, heel, or toe to be made, if necessary, from materials other than shape-memory resins, a choice is made from a variety of known materials according to the service a given shoe performs. It is desirable to choose materials which can be integrated by adhesion or fusion with the shape-memory resins constituting the aforesaid instep and shaft. Such choice may be made from known rubbers, for example, natural rubber and/or synthetic rubber, where the shape-memory resins are polyisoprene.

The process of this invention for manufacturing shoes from shape-memory resins is not specified and a known process, for example, one-piece injection-molding of shape-memory resins into shoes, may be utilized. It is, however, desirable to apply the following procedure.

At least the instep of a shoe or, where a shaft is present, at least the instep and shaft are made from a sheet of uncrosslinked shape-memory resins, other parts of the shoe which are not made from the shape-memory resins are made from a sheet of uncrosslinked rubber, a liner sock made of elastic and slippery synthetic fibers is put on a last, the parts made from the shape-memory resins and, if necessary, the other parts made from the rubber are pasted to the surface of the liner sock with the aid of an adhesive to yield a half-finished shoe, the half-finished shoe is dried, if necessary, and cured by heating at a temperature equal to or above the crosslinking temperature of said shape-memory resins or the crosslinking temperatures of said shape-memory resins and rubber, and the finished shoe is cooled and removed from the last. For a shoe intended for a specific area of service, this procedure allows selection of suitable materials for the sole, heel, toe, instep, and shaft, particularly sole, heel, and toe, to enhance its performance.

It is also possible to manufacture the folding shoe of this invention in one piece by injection molding of shape-memory resins.

Moreover, the folding shoe of this invention can be made in the following manner. A piece of suitable cloth is spread-coated with uncrosslinked shape-memory resins to form a sheet having a layer of cloth and a layer of the uncrosslinked shape-memory resins, at least the instep of a shoe or, where a shaft is present, at least the instep and the shaft are cut from the sheet, other parts of the shoe not made from the sheet of the shape-memory resins are cut from a sheet of uncrosslinked rubber, the cut parts are stitched together and/or pasted together to yield a half-finished shoe, and the half-finished shoe is cured by heating at a temperature equal to or above the crosslinking temperature of said shape-memory resins or the crosslinking temperatures of said shape-memory resins and rubber.

EXAMPLES

This invention will be described in detail with reference to the accompanying examples, though not limited thereto.

Example 1

FIG. 1 illustrates a rain shoe (boot) related to Example 1 of this invention. The rain boot (1) has a shoe body composed of a sole (2), a heel (3) which is situated above the sole and covers the heel of a foot, a toe (4) which is situated in front of the heel (3) and covers the toes of a foot, an instep (5) which is situated above the heel (3) and the toe (4) and covers the instep and the ankle of a foot, and a shaft (6) which is situated above the instep (5) and covers the leg. The rain boot (1) is injection-molded in one piece from shape-memory polyurethane (MM-4500 available from Mitsubishi Heavy Industries, Ltd.) with an average glass transition temperature ($T_g$) of 45° C. and its inside is pasted, simultaneously with the injection molding, to an elastic and slippery liner made of synthetic fibers (not shown in the figure).

Figure 2:
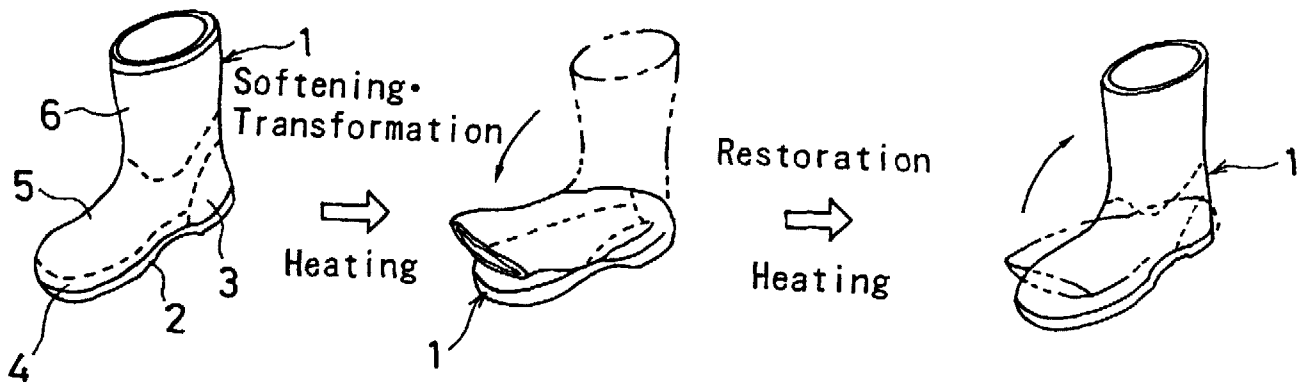
FIG. 2 shows how to fold the rain boot of FIG. 1 and to restore to the original shape.
Figure 3:
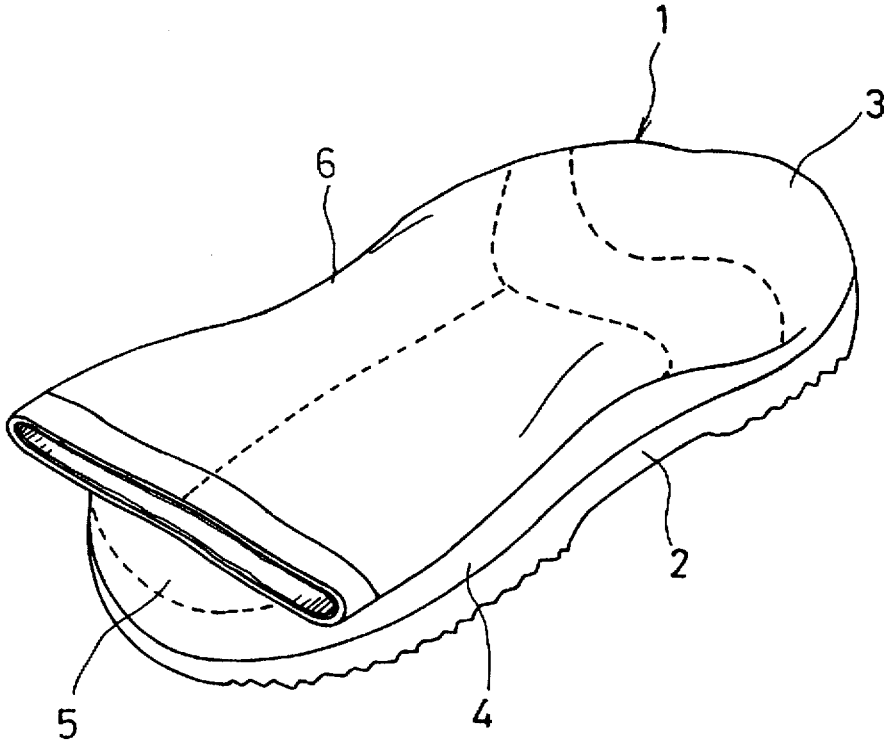
FIG. 3 is a magnified oblique projection drawing of the rain boot of FIG. 2 in the folded state.

Thus, the rain boot (1) made in whole from shape-memory resin with $T_g$ of 45° C. can be folded and fixed in the folded shape, while not in use, for storage or carrying as illustrated in FIGS. 2 and 3 by heating at a temperature above the $T_g$ of 45° C., for example, at 50° to 60° C., and cooling in the folded state. At the time of use, the folded boot can be restored to the initial molded shape by heating at a temperature above the $T_g$ of 45° C., for example, at 50° to 60° C.

Example 2

Figure 4:
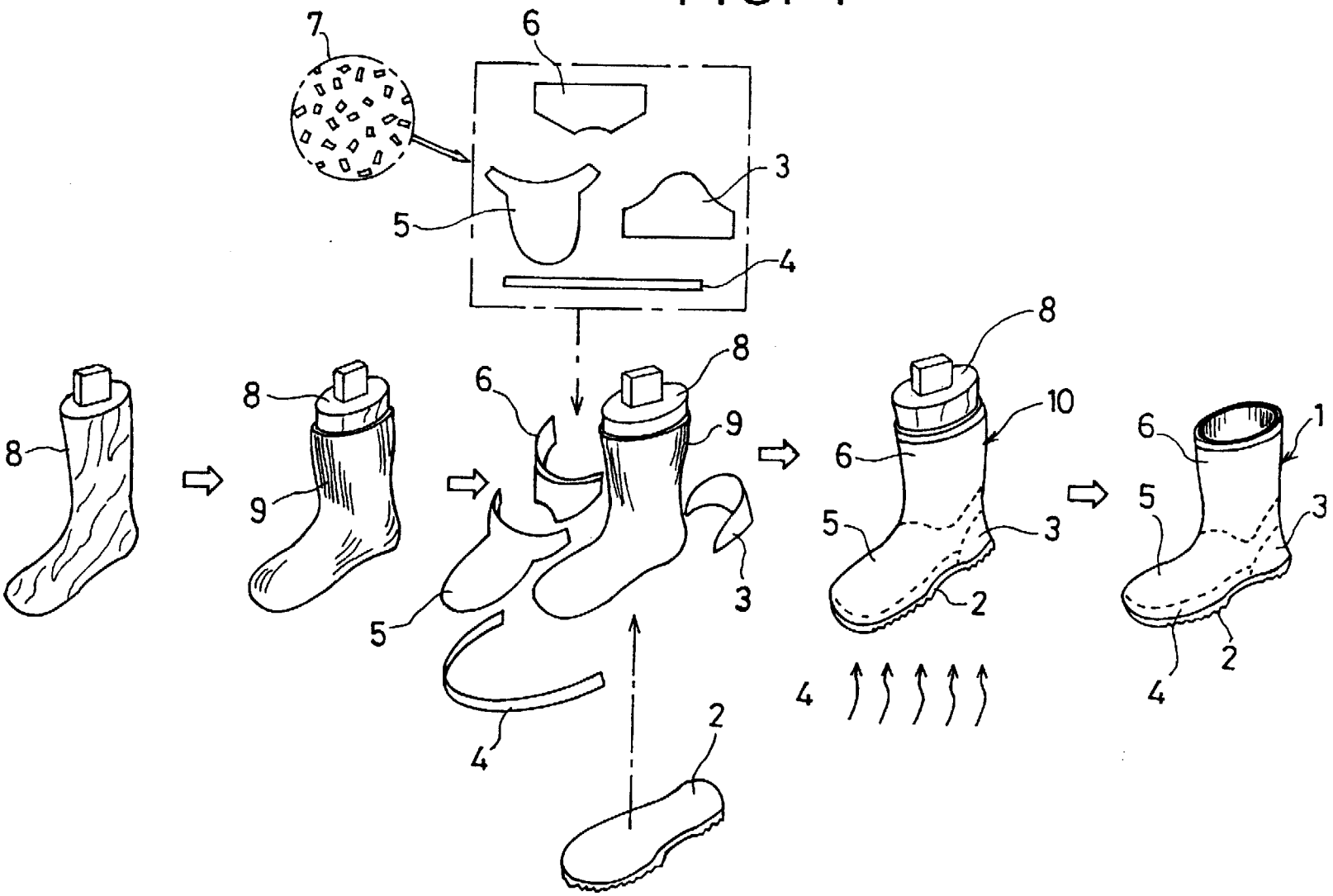
FIG. 4 illustrates a manufacturing process of a folding rain boot in another example of this invention.

FIG. 4 illustrates a rain boot and a process for manufacturing the same related to Example 2 of this invention. The rain boot in question is manufactured in the following steps.

Shape-memory polyisoprene with an average glass transition temperature ($T_g$) of 67° C. (TP-301 available from Kuraray Co., Ltd.) as shape-memory resin (7) was formed into a sheet and cut to make a heel (3), a toe (4), an instep (5), and a shaft (6) constituting the rain boot (1) while a sheet of unvulcanized rubber was used to make a sole (2).

A liner sock (9) made of elastic and slippery synthetic fibers was put on a last (8) for the manufacture of a boot and the heel (3), the toe (4), the instep (5), and the shaft (6) made from the aforesaid shape-memory resin and the sole (2) made of the unvulcanized rubber were pasted to the surface of the liner sock to yield a half-finished boot (10).

The half-finished boot (10) was placed in a vulcanizer and heated above the crosslinking temperature of the aforesaid shape-memory resin and the vulcanization temperature of the rubber or at 100° to 200° C. to effect the crosslinking of the shape-memory resin and the vulcanization of the rubber, and the product rain boot was cooled and removed from the last (8).

The parts (3), (4), (5), and (6) made from the uncrosslinked shape-memory resin and the part (2) made from the unvulcanized rubber are fit together and fused into one piece during the thermal curing step.

The rain boot (1) of this example, excepting its sole (2), is made from the shape-memory resin with a glass transition temperature ($T_g$) of 67° C. Thus, the portion other than the sole (2), while not in use, can be folded and fixed in the folded shape as illustrated in FIG. 3 by heating at a temperature above the aforesaid $T_g$ of 67° C., for example, at 67° to 80° C., and cooling in the folded state for storage and carrying. At the time of use, the folded shape can be restored to the initial molded shape by heating as above.

Figure 5:
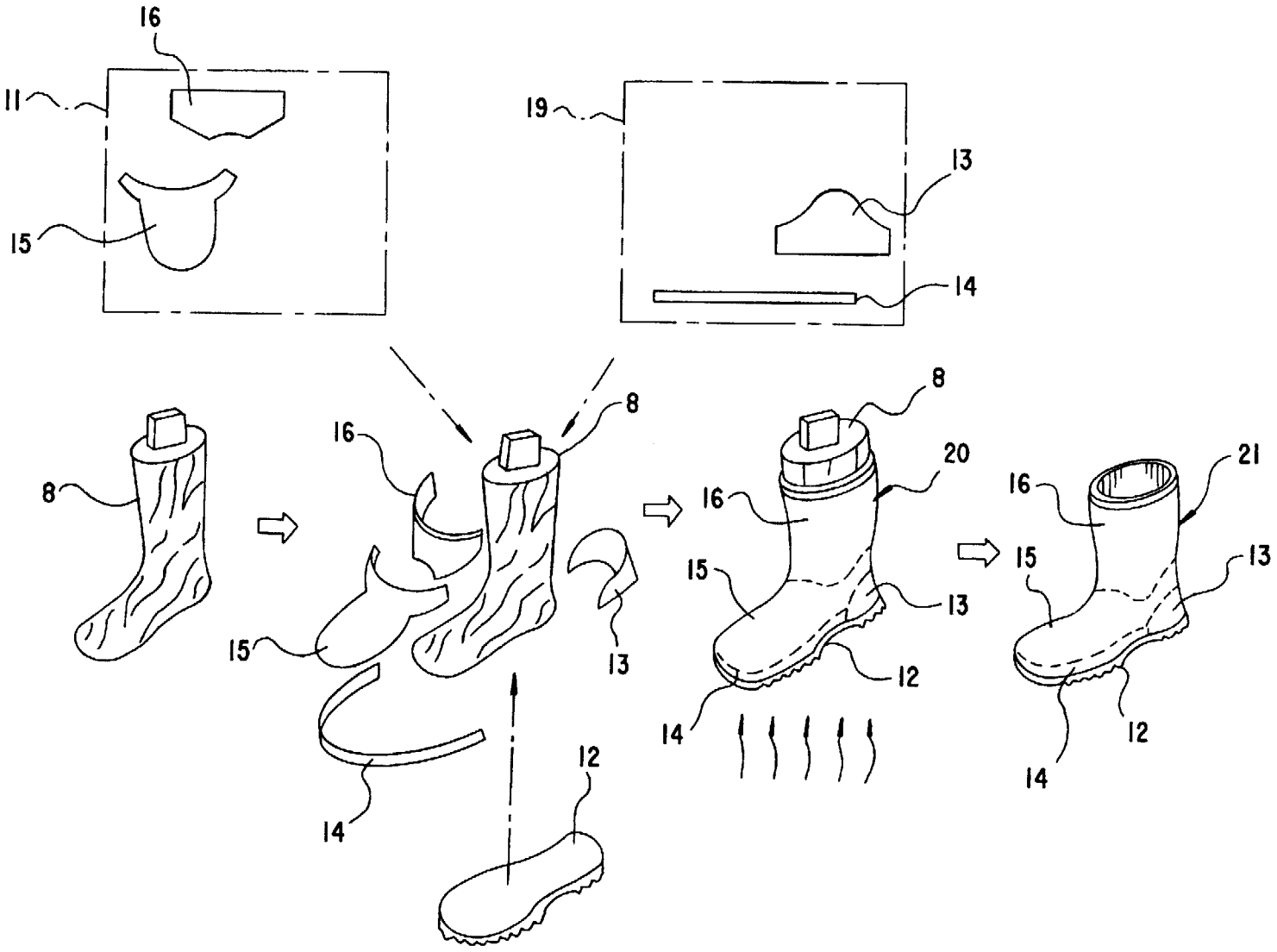
FIG. 5 illustrates a rain boot and a process for manufacturing the same according to the invention.

FIG. 5 illustrates a rain boot and a process for manufacturing the same according to the invention. The rain boot is manufactured by the following steps.

A piece of suitable cloth is spread-coated with uncrosslinked shape-memory resins to from a sheet (11) having a layer of cloth and a layer of the uncrosslinked shape-memory resins. The instep (15) and the shaft (16) are cut from the sheet (11). Other parts of the boot including the heel (13) and the toe (14) are cut from a sheet (19) of uncrosslinked rubber. The cut parts (13), (14), (15) and (16) along with a sole (12) are pasted together about a last (8) to yield a half-finished boot (20). The half-finished shoe (20) is cured by heating at a temperature equal to or above the crosslinking temperatures of the shape-memory resins and the uncrosslinked rubber to yield the finished boot (21).

What is claimed is:

1. A process for manufacturing a folding shoe having an instep which comprises making a sheet composed of a cloth spread coated with uncrosslinked shape-memory resins which form shape-memory resins having a glass transition temperature of 40° to 70° C. upon curing, cutting parts from said sheet coated with uncrosslinked shape-memory resins into shapes including at least said instep, joining parts including the parts made from said sheet together by at least one of stitching or pasting to furnish a half-finished shoe, and curing said half-finished shoe by heating at a temperature at least equal to the crosslinking temperature of said uncrosslinked shape-memory resins.

2. A process according to claim 1, wherein the shoe includes a shaft and said shaft is made from the sheet composed of a cloth spread-coated with uncrosslinked shape-memory resins.

3. A process according to claim 1, further including making from a sheet of unvulcanized rubber other parts of said shoe not made from said sheet of uncrosslinked shape-memory resins, and said heating is at a temperature equal or above the crosslinking temperature of said shape-memory resins and said rubber.

4. A process according to claim 3, wherein the shoe includes a shaft and said shaft is made from the sheet composed of a cloth spread-coated with uncrosslinked shape-memory resins.

5. A process according to claim 1, wherein the shape-memory resins are selected from the group consisting of polyurethanes and polyisoprenes.

* * * * *